US008727603B2

(12) United States Patent
Lee et al.

(10) Patent No.: US 8,727,603 B2
(45) Date of Patent: May 20, 2014

(54) LIGHTING APPARATUS

(75) Inventors: Jaeduck Lee, Seoul (KR); Jinwoo Park, Seoul (KR); Seoyoung Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 259 days.

(21) Appl. No.: 13/409,390

(22) Filed: Mar. 1, 2012

(65) Prior Publication Data

US 2013/0039095 A1 Feb. 14, 2013

(30) Foreign Application Priority Data

Aug. 12, 2011 (KR) ..... 10-2011-0080547

(51) Int. Cl.
*F21V 29/00* (2006.01)

(52) U.S. Cl.
USPC ..... 362/640; 362/650; 362/646

(58) Field of Classification Search
USPC ..... 362/640, 646, 650, 294, 373
See application file for complete search history.

(56) References Cited

FOREIGN PATENT DOCUMENTS

| | | | |
|---|---|---|---|
| JP | 2009-004130 | A | 1/2009 |
| JP | 2010-034546 | A | 2/2010 |
| JP | 2010-282838 | A | 12/2010 |
| KR | 10-1028338 | B1 | 4/2011 |

OTHER PUBLICATIONS

Korean Notice of Allowance dated Oct. 29, 2012 issued in Application No. 10-2011-0080547 (with English translation).

*Primary Examiner* — Joseph L Williams
(74) *Attorney, Agent, or Firm* — Ked & Associates, LLP

(57) ABSTRACT

This invention relates to lighting apparatuses, and more particularly to a lighting apparatus which can dissipate heat from a lighting emitting module and an electronic module, reduce weight, and enables easy partial replacement and service.

17 Claims, 7 Drawing Sheets

LIGHTING APPARATUS

CROSS REFERENCE TO RELATED APPLICATION

Pursuant to 35 U.S.C. §119(a), this application claims the benefit of the Patent Korean Application No. 10-2011-0080547, filed on Aug. 12, 2011 which is hereby incorporated by reference as if fully set forth herein.

BACKGROUND OF THE DISCLOSURE

1. Field of the Disclosure

This invention relates to lighting apparatuses, and more particularly to a lighting apparatus which can dissipate heat from a lighting emitting module and an electronic module, reduce weight, and enables easy partial replacement and service.

2. Discussion of the Related Art

In general, a lighting industry has a long history enough to be developed with civilization of mankind, and a very close relation with mankind.

Even today, the lighting industry is kept developing, making a variety of researches on s, light emitting systems, driving systems, improvement on efficiency, and so on.

Presently, as major s for lighting, incandescent lamps, discharge lamps, and fluorescent lamps are used mostly, in various purposes, such as domestic, landscape and industrial purposes.

Of the s, resistant s, such as the incandescent lamps have problems of poor efficiency and substantial heat generation, the discharge lamps have problems of a high price and a high voltage, and the fluorescent lamps have an environmental problem caused by mercury.

In order to solve the drawbacks of the s, interest in a light emitting diode LED is increasing, which has advantages in efficiency, variety of colors, autonomy of design, and so on.

The light emitting diode is a semiconductor device which emits a light when a voltage is applied thereto in a forward direction, and has a long lifetime, low power consumption, and electric, optical, and physical characteristics suitable for mass production, to replace the incandescent lamps and the fluorescent lamps, rapidly.

However, the light emitting diode generates much heat in operation, to cause poor efficiency if the heat is not dissipated to an outside thereof.

And, as the lighting apparatus with the light emitting diode becomes slim and compact, a problem takes place, in which replacement of a whole lighting apparatus is required even if one of the components are out of order.

SUMMARY OF THE DISCLOSURE

Accordingly, this invention is directed to a lighting apparatus.

An object of this invention is to provide a lighting apparatus which can make effective dissipation of heat from a light emitting module and an electronic module.

Another object of this invention is to provide a lighting apparatus which enables easy and partial repair or replacement of components.

Another object of this invention is to provide a lighting apparatus which can reduce weight, reduce production cost, and enhance mass production.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lighting apparatus includes a heat sink, a light emitting module having a substrate arranged on the heat sink, and an LED mounted to the substrate, an outer housing mounted to the heat sink to form an exterior of the lighting apparatus, an inner housing detachably mounted in the outer housing, an electronic module having a circuit part arranged in the inner housing electrically connected to the light emitting module, and an insulating part filled in a space between the circuit part and the inner housing, and a power socket mounted to the outer housing electrically connected to the circuit part.

And, the outer housing may have guide ribs provided in an inside circumferential surface in a placing in direction of the inner housing.

And, the outer housing may have through holes for heat exchange between the electronic module and external air.

And, the lighting apparatus may further include a lens unit having a plurality of light collection lenses each projected toward the light emitting module.

And, the lens unit may be detachably mounted to the heat sink.

And, the heat sink may have a recess for seating the light emitting module therein, and the lens unit is detachably mounted to a side of the recess.

And, the lighting apparatus may further include a heat conductive pad arranged between the heat sink and the light emitting module.

And, the insulating part may be formed of silicone.

In another aspect of the present invention, a lighting apparatus includes a light emitting module having a substrate, and an LED mounted to the substrate, an electronic module having a circuit part electrically connected to the light emitting module and an insulating part which encloses the circuit part, an inner housing for housing the electronic module, an outer housing which forms an exterior of the lighting apparatus having the inner housing detachably mounted thereto, a heat sink having the light emitting module arranged thereto placed in a space between the outer housing and the inner housing, and a power socket mounted to the outer housing electrically connected to the circuit part.

In another aspect of the present invention, a lighting apparatus includes a light emitting module having a substrate and an LED mounted to the substrate, an electronic module having a circuit part electrically connected to the light emitting module and an insulating part which encloses the circuit part, a housing partitioned into a plurality of spaces with partition walls having the electronic module arranged in any one of the spaces, and a heat sink having the light emitting module arranged thereto placed in other space of the housing.

In another aspect of the present invention, a lighting apparatus includes a heat sink having a plurality of outer fins for heat exchange with external air, a light emitting module arranged on the heat sink having a substrate and an LED mounted to the substrate, an electronic module having a circuit part electrically connected to the light emitting module, and an insulating part which encloses the circuit part, and a housing which houses the electronic module having a region placed in the heat sink, wherein the heat sink has a plurality of inner fins in contact with the housing.

It is to be understood that both the foregoing general description and the following detailed description of this invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of this invention, examples of which are illustrated in the accompanying drawings.

Wherever possible, the same reference numbers will be used throughout the drawings to refer to the same or like parts, repetitive description will be omitted, and a size or a shape can be exaggerated, or reduced for convenience of description.

In the meantime, though terms including ordinal number, such as first or second, can be used for describing various elements, the elements are not limited by the terms, and are used only for making one element distinctive from other elements.

Figure 1:
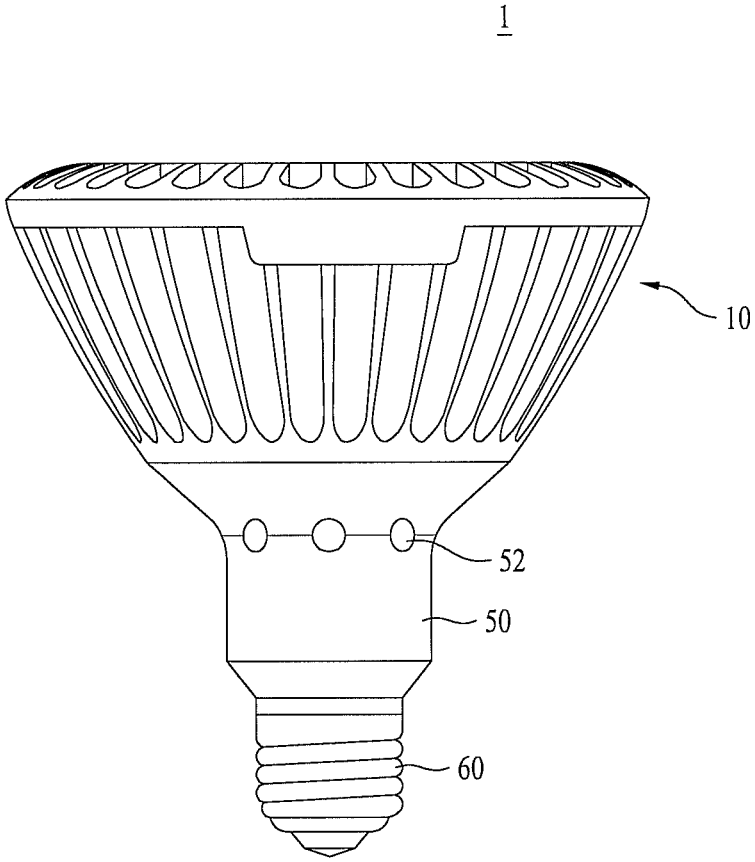
FIG. 1 illustrates a side view of a lighting apparatus related to a preferred embodiment of this invention.
Figure 2:
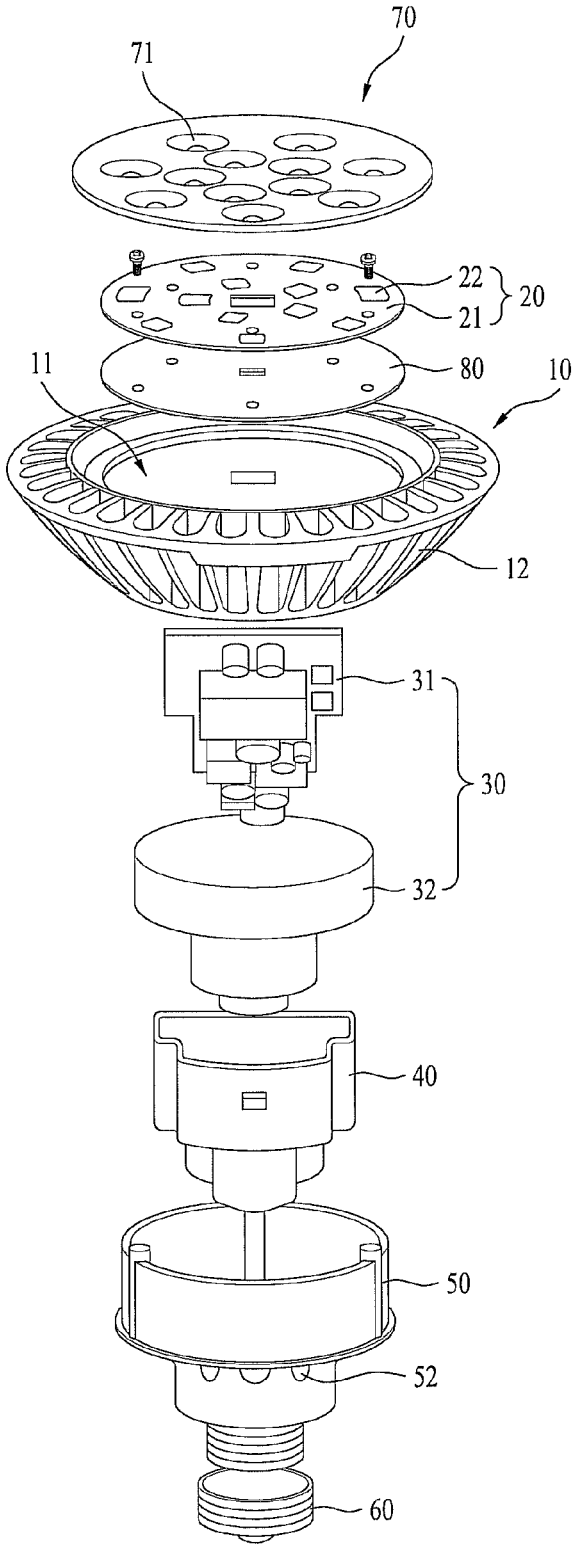
FIG. 2 illustrates an exploded perspective view of the lighting apparatus in FIG. 1.
Figure 3:
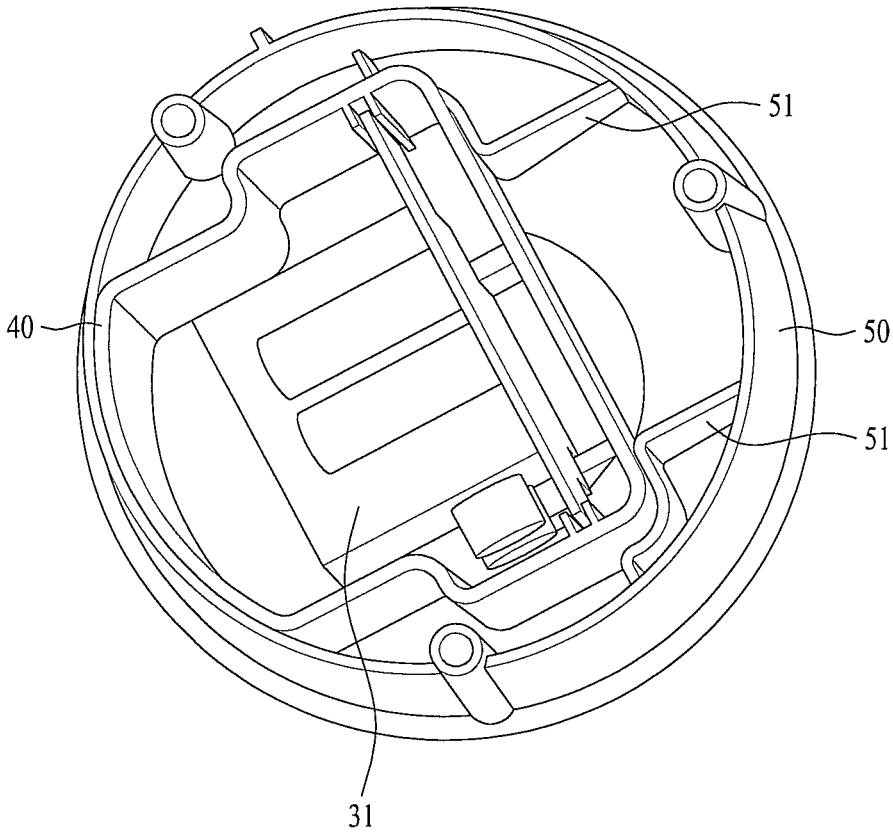
FIG. 3 illustrates a perspective view of an assembly of some of elements of the lighting apparatus in FIG. 2.

FIG. 1 illustrates a side view of a lighting apparatus related to a preferred embodiment of this invention, FIG. 2 illustrates an exploded perspective view of the lighting apparatus in FIG. 1, and FIG. 3 illustrates a perspective view of an assembly of some of elements of the lighting apparatus in FIG. 2.

Referring to FIGS. 1 to 3, the lighting apparatus 1 includes a heat sink 10, a light emitting module 20 having a substrate 21 arranged on the heat sink 10, and an LED 22 mounted to the substrate 21, an outer housing 50 mounted to the heat sink 10 to form an exterior of the lighting apparatus 1, an inner housing 40 detachably mounted in the outer housing 50, an electronic module 30 having a circuit part 31 arranged in the inner housing 40 electrically connected to the light emitting module 20, and an insulating part 32 filled in a space between the circuit part 31 and the inner housing 40, and a power socket 60 mounted to the outer housing 50 electrically connected to the circuit part.

All elements of the lighting apparatus 1 will be described with reference to attached drawings.

The lighting apparatus 1 includes a heat sink 10, a light emitting module 20, an outer housing 50 mounted to the heat sink 10, an inner housing 40 arranged in the outer housing 50, and an electronic module 40 arranged in the inner housing 40.

The light emitting module 20 includes a substrate 21 arranged on the heat sink 10, and an LED 22 mounted to the substrate. The LED 22 may be a light emitting diode LED. And, the LED 22 may be plural in number radially mounted to the substrate 21.

And, the electronic module 40 includes a circuit part 31 connected to the light emitting module 20 electrically for supplying power thereto, and an insulating part 32 filled in a space between the circuit part 31 and the inner housing 40 for insulating the circuit part 31. The circuit part 31 may include components, such as a converter for converting utility power to DC power, a transformer for regulating a voltage, and etc.

The insulating part 32 may be formed of silicone.

The outer housing 50 is mounted to the heat sink 10 to form an exterior of the lighting apparatus 1. And, the inner housing 40 is housed in the outer housing 50 in which the electronic module 30 is housed.

The outer housing 50 may have an inside circumferential surface provided with guide ribs 50 in a placing in direction of the inner housing 40. The guide ribs 50 may serve aligning and securing a position of the inner housing when the inner housing 40 is being placed in.

The inner housing 40 is detachably mounted to the outer housing 50. Therefore, if it is required to repair or replace the electronic module 30, since the electronic module 30 may be repaired or the inner housing 40 may be replaced with another inner housing having a new electronic module 30 after separating the inner housing 40 from the outer housing 50, replacement of an entire lighting apparatus 1 is not required, and the repair and the service is easy.

The inner housing 40 and the outer housing 50 function to insulate the heat sink 10 from the electronic module 30. The outer housing 50 has a power socket 60 mounted thereto for supplying utility power.

The heat sink 10 is formed of metal for fast dissipation of heat from the light emitting module 20, and may be provided with a plurality of outside fins for increasing a contact area to external air.

The heat sink 10 may have a recess 11 for seating the light emitting module 20, and a space therein for placing the outer housing 50 therein.

The lighting apparatus 1 may include a lens unit 70 having a plurality of light collection lenses 71 projected toward the light emitting module 20. The light collection lens 71 makes the light from the LED 22 to converge and project in one direction. Each of the light collection lenses 71 has a recess at a center and a sloped surface around the recess. Each of the recess is provided at a position facing the LED 22.

In the meantime, the lens unit 70 may be detachably mounted to the heat sink 10. As described before, the heat sink 10 may have a recess 11 for seating the light emitting module 20 thereon. In this case, the lens unit 70 may be detachably mounted to a side of the recess 11. As an example, the lens unit 70 may have a plurality of projections on an outside circumference, and the recess 11 may have recesses in the side of the recess 11 for placing the projections therein.

The lighting apparatus 1 may have a heat conductive pad 80 arranged between the heat sink 10 and the light emitting module 20, additionally. The heat conductive pad 80 maximizes a heat transfer performance between the light emitting module 20 and the heat sink 10, enlarges a contact area between the light emitting module 20 and the heat sink to improve heat dissipation efficiency. Since the heat conductive pad 80 is formed of a flexible material, the contact area can be enlarged.

In the meantime, in order to make effective heat dissipation from the electronic module 30, the outer housing 50 may be provided with through holes 52 for heat exchange between the electronic module 30 and external air.

Eventually, the lighting apparatus 1 related to a preferred embodiment of this invention can make effective dissipation of heat from the light emitting module and the electronic module.

And, the lighting apparatus 1 related to a preferred embodiment of this invention can make easy repair and replacement of some of the components (Especially, the electronic module).

Figure 4:
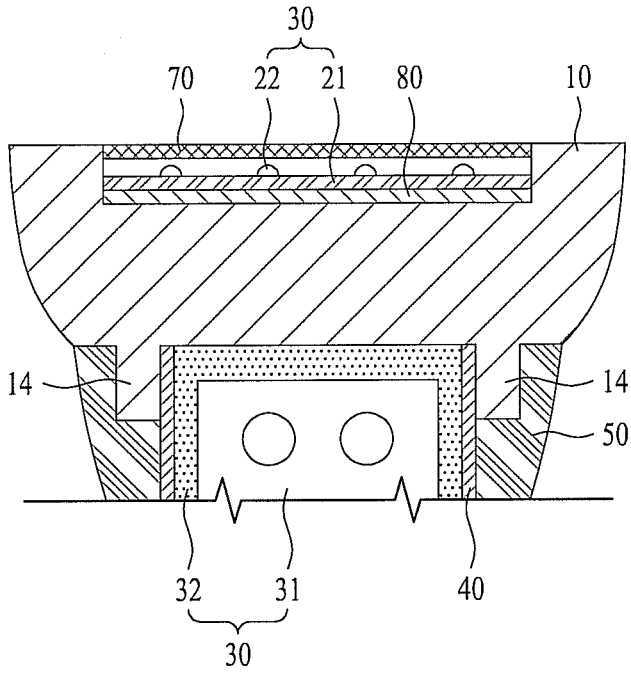
FIG. 4 illustrates a longitudinal section of a lighting apparatus related to another preferred embodiment of this invention.

FIG. 4 illustrates a longitudinal section of a lighting apparatus related to another preferred embodiment of this invention. The lighting apparatus related to another embodiment shown in FIG. 4 is different from the foregoing embodiment only in a structure of the heat sink 10 for dissipating heat from the electronic module 30. Identical elements will be described with reference to FIGS. 1 to 3, and duplicate description will be omitted.

Referring to FIG. 4, the lighting apparatus 1 includes a light emitting module 20 having a substrate 21, and an LED 22 mounted to the substrate 21, an electronic module 30 having a circuit part 31 electrically connected to the light emitting module 20 and an insulating part 32 enclosing the circuit part 31, an inner housing 40 for housing the electronic module 30, an outer housing 50 which forms an exterior of the lighting apparatus having the inner housing detachably mounted thereto, a heat sink 10 having the light emitting module 20 arranged thereto placed in a space between the outer housing 50 and the inner housing 40, and a power socket 60 mounted to the outer housing 50 electrically connected to the circuit part 31.

The heat sink 10 has a projection 14 placed in a space between the outer housing 50 and the inner housing 40 for enhancing heat dissipation efficiency of the electronic module 30.

Figure 5:
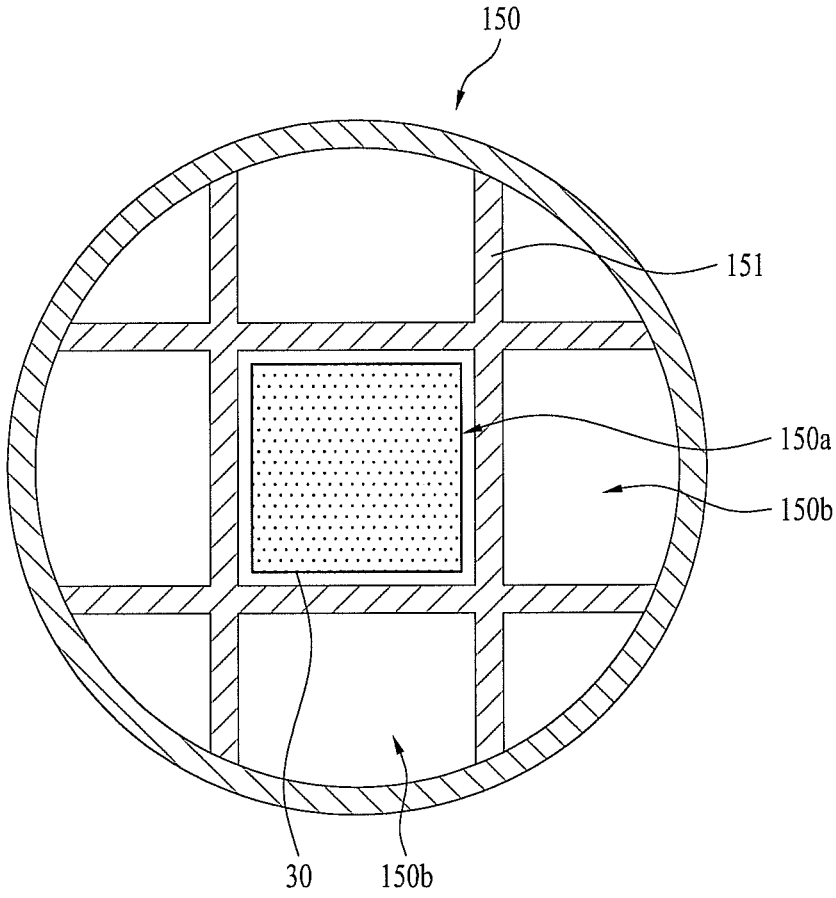
FIG. 5 illustrates a horizontal section of a lighting apparatus related to another preferred embodiment of this invention.

FIG. 5 illustrates a horizontal section of a lighting apparatus related to another preferred embodiment of this invention. The lighting apparatus related to another embodiment shown in FIG. 5 is different from the foregoing embodiment only in a structure of a housing 50 for dissipating heat from the electronic module 30. Identical elements will be described with reference to FIGS. 1 to 4, and duplicate description will be omitted.

Referring to FIG. 5, the lighting apparatus 1 includes a light emitting module 20 having a substrate 21 and an LED 22 mounted to the substrate 21, an electronic module 30 having a circuit part 31 electrically connected to the light emitting module 20 and an insulating part 32 which encloses the circuit part 31, a housing partitioned into a plurality of spaces 150*a* and 150*b* with partition walls 151, having the electronic module 30 arranged in one of the spaces 150*a*, and a heat sink 10 having the light emitting module 20 arranged thereto placed in other space 150*b* of the housing 150.

The housing 150 has a structure in which the housing 150 is, not separate as the outer housing 50 and the inner housing 40 like the foregoing embodiments, but partitioned into a plurality of spaces with the partition walls 151. And, the electronic module 30 may be arranged secured to any one space 150*a* of the housing 150, or detachably arranged to any one space 150*a* of the housing 150.

In order to enhance heat dissipation efficiency of the electronic module 30, the heat sink 10 includes a projection placed in another space 150*b* of the housing 150.

In the meantime, since it is not favorable for heat dissipation of heat from the electronic module 30 if a space between the electronic module 30 and the housing 150 is filled with air, it is preferable that the housing 150 has spaces 150*b* filled with at least one of the heat sink 10 or an insulating material (For an example, silicone) except the space 150*a* having the electronic module 30 arranged thereto.

Figure 6:
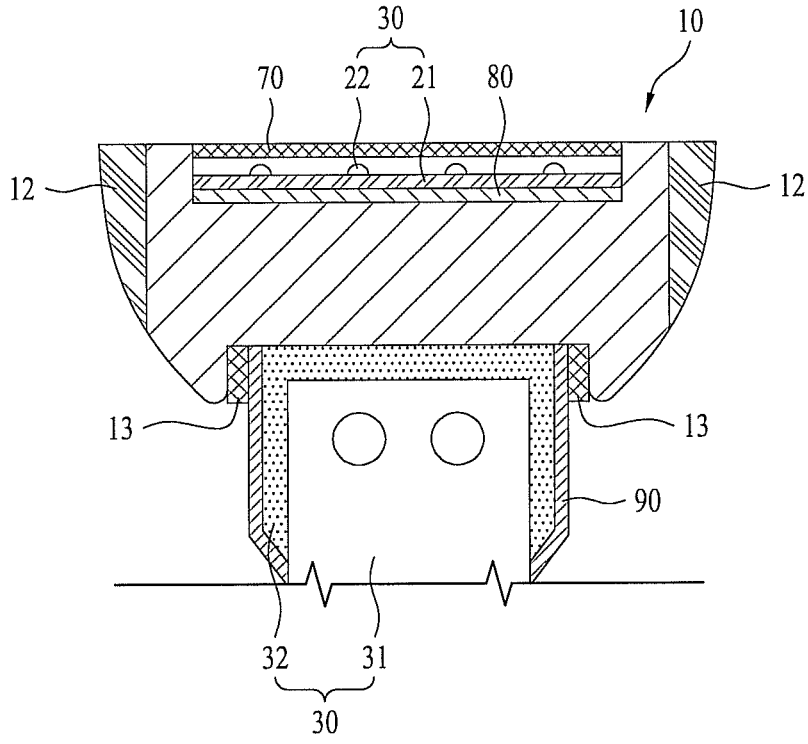
FIG. 6 illustrates a longitudinal section of a lighting apparatus related to another preferred embodiment of this invention.
Figure 7:
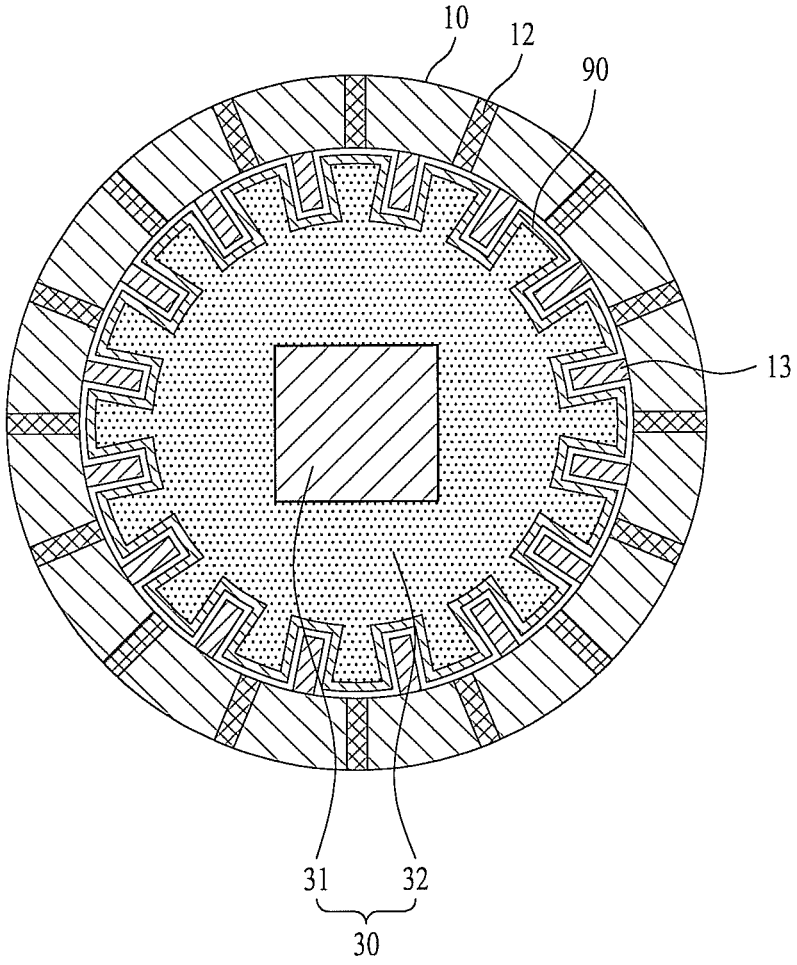
FIG. 7 illustrates a horizontal section of a lighting apparatus related to another preferred embodiment of this invention.

FIG. 6 illustrates a longitudinal section of a lighting apparatus related to another preferred embodiment of this invention, and FIG. 7 illustrates a horizontal section of a lighting apparatus related to another preferred embodiment of this invention.

Referring to FIGS. 6 and 7, the lighting apparatus is different from the foregoing embodiments only in a structure of a heat sink 10 for dissipating heat from the electronic module 30 and the light emitting module 20. Identical elements will be described with reference to FIGS. 1 to 5, and duplicate description will be omitted.

Referring to FIGS. 6 and 7, the lighting apparatus includes a heat sink 10 having a plurality of outer fins 12 for heat exchange with external air, a light emitting module 20 arranged on the heat sink 10 having a substrate 21 and an LED 22 mounted to the substrate 21, an electronic module 30 having a circuit part 31 electrically connected to the light emitting module 20, and an insulating part 32 which encloses the circuit part 32, and a housing 90 which houses the electronic module 30, having a region placed in the heat sink.

The heat sink 10 has a plurality of inner fins 13 in contact with the housing 90. That is, in order to increase a heat exchange area with the housing 90 having the electronic module 30 placed therein, the heat sink 10 has a plurality of inner fins 13, and the housing 90 may have a region thereof placed in the heat sink in contact with the inner fins 13.

As described before, the housing 90 may include an inner housing for housing the electronic module 30, and an outer housing for housing the inner housing. In this case, the outer housing may be placed in the heat sink so as to be in contact with the inner fins. In the meantime, if the housing 90 has the outer housing and the inner housing separated from each other, the inner housing may be detachably arranged to the outer housing for making replacement and service easy.

Referring to FIG. 7, the housing 90 may have a plurality of projections each arranged in a space between two adjacent inner fins 13.

As has been described, the lighting apparatus related to this invention has the following advantages.

Effective dissipation of heat from the light emitting module and the electronic module can be made.

Partial repair and replacement of components is easy.

A production cost can be reduced, and mass production can be enhanced.

It will be apparent to those skilled in the art that various modifications and variations can be made in this invention without departing from the spirit or scope of the inventions. Thus, it is intended that this invention covers the modifications and variations of this invention provided they come within the scope of the appended claims and their equivalents.

What is claimed is:

1. A lighting apparatus comprising:

a heat sink;

a light emitting module including an LED provided over the heat sink;

an outer housing mounted to the heat sink to form an exterior of the lighting apparatus;

an inner housing detachably mounted in the outer housing;

an electronic module including a circuit part disposed in the inner housing electrically connected to the light emitting module, and an insulating part filled in a space between the circuit part and the inner housing; and a power socket mounted to the outer housing electrically connected to the circuit part.

2. The lighting apparatus as claimed in claim 1, wherein the outer housing has guide ribs provided in an inside circumferential surface thereof.

3. The lighting apparatus as claimed in claim 1, wherein the outer housing has through holes for heat exchange between the electronic module and external air.

4. The lighting apparatus as claimed in claim 1, further comprising a lens unit having a plurality of light collection lenses each projected toward the light emitting module.

5. The lighting apparatus as claimed in claim 4, wherein the lens unit is detachably mounted to the heat sink.

6. The lighting apparatus as claimed in claim 5, wherein the heat sink has a recess for seating the light emitting module therein, and the lens unit is detachably mounted to a side of the recess.

7. The lighting apparatus as claimed in claim 1, further comprising a heat conductive pad disposed between the heat sink and the light emitting module.

8. The lighting apparatus as claimed in claim 1, wherein the insulating part is formed of silicone.

9. A lighting apparatus comprising:

a light emitting module including a substrate, and an LED mounted to the substrate;

an electronic module including a circuit part electrically connected to the light emitting module and an insulating part which encloses the circuit part;

an inner housing for surrounding the electronic module;

an outer housing to detachably receive the inner housing therein;

a heat sink to dissipate heat from the light emitting module, the heat sink disposed in a space between the outer housing and the inner housing; and a power socket mounted to the outer housing electrically connected to the circuit part.

10. A lighting apparatus comprising:

a light emitting module including a substrate and an LED mounted to the substrate;

an electronic module including a circuit part electrically connected to the light emitting module and an insulating part which encloses the circuit part;

a housing partitioned into a plurality of spaces with partition walls having the electronic module disposed in any one of the spaces; and a heat sink to dissipate heat from the light emitting module, the heat sink placed in other space of the housing.

11. The lighting apparatus as claimed in claim 9, wherein the outer housing has through holes for heat exchange between the electronic module and external air.

12. The lighting apparatus as claimed in claim 9, further comprising a lens unit detachably mounted to the heat sink having a plurality of light collection lenses each projected toward the light emitting module.

13. The lighting apparatus as claimed in claim 10, wherein the housing has spaces filled with at least one of the heat sink or an insulating material, except a space having the electronic module disposed therein.

14. A lighting apparatus comprising:

a heat sink including a plurality of outer fins for heat exchange with external air;

a light emitting module including an LED provided over the heat sink;

an electronic module including a circuit part electrically connected to the light emitting module, and an insulating part which encloses the circuit part; and a housing to surround the electronic module, the housing having a region placed in the heat sink, wherein the heat sink includes a plurality of inner fins in contact with the housing.

15. The lighting apparatus as claimed in claim 14, wherein the housing includes;

an inner housing for surrounding the electronic module, and an outer housing for surrounding the inner housing, wherein the outer housing is in contact with the inner fins.

16. The lighting apparatus as claimed in claim 15, wherein the inner housing is detachably provided to the outer housing.

17. The lighting apparatus as claimed in claim 10, wherein the housing has a plurality of projections each provided in a space between two adjacent inner fins.

* * * * *